US006543533B2

(12) United States Patent
Meek et al.

(10) Patent No.: US 6,543,533 B2
(45) Date of Patent: Apr. 8, 2003

(54) WELL TUBING ROTATOR

(75) Inventors: Robert K. Meek, Bakersfield, CA (US); Rex E. Duhn, Bakersfield, CA (US)

(73) Assignee: Duhn Oil Tool, Inc., Bakersfield, CA (US)

( * ) Notice: Subject to any disclaimer, the term of this patent is extended or adjusted under 35 U.S.C. 154(b) by 0 days.

(21) Appl. No.: 09/798,436

(22) Filed: Mar. 2, 2001

(65) Prior Publication Data

US 2002/0121367 A1 Sep. 5, 2002

(51) Int. Cl.[7] ..... E21B 33/04

(52) U.S. Cl. ..... 166/78.1; 166/104; 166/241.6

(58) Field of Search ..... 166/78.1, 117.1, 166/75.14, 104, 241.6

(56) References Cited

U.S. PATENT DOCUMENTS

| | | | | |
|---|---|---|---|---|
| 1,650,102 | A | 11/1927 | Tschappat | |
| 1,662,984 | A | 3/1928 | Scott et al. | |
| 1,965,907 | A | 7/1934 | Pierce | |
| 2,178,700 | A | 11/1939 | Penick et al. | |
| 2,294,061 | A | 8/1942 | Williamson | 166/14 |
| 2,471,198 | A | 5/1949 | Cormany | 166/14 |
| 2,595,434 | A | 5/1952 | Williams | 166/14 |
| 2,599,039 | A | 6/1952 | Baker | 166/14 |
| 2,630,181 | A | 3/1953 | Solum | 166/14 |
| 2,660,248 | A | 11/1953 | Brown | |
| 2,693,238 | A | 11/1954 | Baker | 166/78 |
| 2,694,450 | A | 11/1954 | Osbun | |
| 2,696,261 | A | 12/1954 | Ennis | |
| 2,788,073 | A | 4/1957 | Brown | 166/78 |
| 2,830,665 | A | 4/1958 | Burns et al. | |
| 3,100,538 | A | 8/1963 | Sanders | |
| 3,191,683 | A | 6/1965 | Alexander | |
| 3,239,016 | A | 3/1966 | Alexander | |
| 3,301,324 | A | 1/1967 | Smith | 166/5 |

(List continued on next page.)

FOREIGN PATENT DOCUMENTS

| | | |
|---|---|---|
| CA | 896339 | 3/1972 |
| CA | 2160668 | 8/1995 |
| CA | 2210239 | 12/1997 |
| EP | 0535277 | 4/1993 |
| GB | 2165282 A | 4/1986 |
| GB | 2172633 A | 9/1986 |
| GB | 2219327 A | 12/1989 |
| GB | 2251013 A | 6/1992 |

OTHER PUBLICATIONS

Rodec Tool Company, Inc., Rodec Auto–Turn Tubing Rotator, Rodec Brochure, Canada, Aug., 1994, 6 Pages.

Lacy, R.D., The Rotating Tubing Hanger System: A Unique New System Designed to Extend the Run Time of Rod Pumped Walls, Society of Petroleum Engineers Paper No. 23977, U.S.A., Mar. 1992, 4 Pages.

Make Your Profits Take A Turn For The Better, Rodec Ultimate Tubing Head Rotator, Campbell Industries Ltd., 4 pages (undated).

Abil Tubing Rotators Information, Abil's Different Tubing Rotators, Abil Alberta Basic Industries Ltd., 4 pages (undated).

R&M Energy Systems, Tubing Wear Prevention Solutions from R&M Energy Systems, 2 pages, 2001.

*Primary Examiner*—David Bagnell
*Assistant Examiner*—Daniel P Stephenson
(74) *Attorney, Agent, or Firm*—Christie, Parker & Hale, LLP

(57) ABSTRACT

A mandrel rotator is provided is mounted in a housing for coupling to a well casing head. The mandrel rotator comprises of an annular gear having external gear teeth and an axial opening. The annular gear is coupled to a mandrel outer surface, such that rotation of the annular gear causes rotation of the mandrel. A retainer limits or prevents axial movement of gear within the housing. A second gear is coupled to the annular gear for rotating the annular gear.

42 Claims, 3 Drawing Sheets

U.S. PATENT DOCUMENTS

| | | | | |
|---|---|---|---|---|
| 3,494,638 | A | | 2/1970 | Todd et al. ..... 285/93 |
| 3,851,714 | A | | 12/1974 | Visser et al. |
| 4,278,278 | A | | 7/1981 | Chambless et al. |
| 4,601,343 | A | | 7/1986 | Lindsey, Jr. et al. |
| 4,630,688 | A | | 12/1986 | True et al. |
| 4,716,961 | A | | 1/1988 | Makins, Jr. et al. ..... 166/68.5 |
| 4,787,457 | A | | 11/1988 | Webster et al. |
| 4,993,276 | A | | 2/1991 | Edwards |
| 4,995,464 | A | | 2/1991 | Watkins et al. |
| 5,036,927 | A | | 8/1991 | Willis ..... 175/162 |
| 5,054,550 | A | | 10/1991 | Hodge ..... 166/78 |
| 5,139,090 | A | | 8/1992 | Land ..... 166/369 |
| 5,327,975 | A | | 7/1994 | Land |
| 5,383,519 | A | | 1/1995 | Wright et al. ..... 166/78 |
| 5,388,639 | A | | 2/1995 | Betchan et al. ..... 166/78 |
| 5,427,178 | A | | 6/1995 | Bland ..... 166/78 |
| 5,429,188 | A | | 7/1995 | Cameron et al. ..... 166/78 |
| 5,431,230 | A | | 7/1995 | Land et al. ..... 166/369 |
| 5,465,788 | A | | 11/1995 | Wright ..... 166/78.1 |
| 5,732,777 | A | | 3/1998 | Grimshaw et al. ..... 166/382 |
| 5,794,693 | A | | 8/1998 | Wright et al. ..... 166/85.5 |
| 5,875,841 | A | | 3/1999 | Wright et al. ..... 166/85.4 |
| 5,964,286 | A | | 10/1999 | Cuppen ..... 166/78.1 |
| 6,012,519 | A | | 1/2000 | Allen et al. |
| 6,026,898 | A | | 2/2000 | Bland et al. |
| 6,119,553 | A | * | 9/2000 | Yamagishi et al. ..... 277/410 |
| 6,199,630 | B1 | * | 3/2001 | Blundell et al. ..... 166/75.14 |

* cited by examiner 40
16
374
376
50
46
384
380
388
378
382
386
390
392
372

WELL TUBING ROTATOR

BACKGROUND OF THE INVENTION

The present invention is related to a tubing rotator and specifically to a tubing rotator for rotating a tube mounted on a hanger within a wellhead.

A tubing string is fitted in well casing head for providing a conduit for a pump jack rod coupled to a pump jack that is used to pump fluids out of the well. The tubing string is mounted within the well casing head on a hanger landed in the casing head. After the tubing string is mounted, a housing having a central opening is mounted on the casing head enclosing the tubing string within the casing head. The pump jack rod extends outside of the housing through the axial opening.

With use, the rod engages the sidewall of the tubing string leading to wear and failure of the tubing string. To prolong the life of the tubing string, tubing rotators are used for rotating the tubing string during the pumping action of the rod, i.e., the up and downward movement of the rod. In this regard, during pumping, the rod makes contact with different areas of the tubing string and as such wear is not concentrated in a single area of the tubing string, thus prolonging the life of the tubing string.

Current rotating mechanisms used to rotate tubing strings are installed into the well casing head after the tubing hanger is completely installed. Consequently, additional service personnel are required to install the rotating mechanism after installation of the hanger. Some rotating mechanisms even offset the location of the housing. Consequently, the length of the linkage driving the pump rod has to be altered.

Consequently, a rotating mechanism is desired that can be easily installed after the hanger has been landed, which does not offset the location of the housing and which allows for a larger diameter tubing rotating gear to be installed thereby providing for greater gear reduction and as such, requiring less force for rotating the gear and thus, the tubing string.

SUMMARY OF THE INVENTION

A tubing rotator is provided which is incorporated in the housing coupled on a well casing head. The rotator comprises a first gear fitted within the housing and having an axial opening a portion of which is polygonal. A tubing mandrel (also referred to herein as the "mandrel" for convenience) is coupled to the tubing string. The tubing mandrel has a portion of its outer surface that is also polygonal and is preferably complementary to the polygonal portion of the gear axial opening. A retainer retains the gear within the housing. A second gear, as for example a worm gear preferably having a spiral tooth is transversely fitted within the housing and is coupled to the first gear, i.e., the teeth of the first gear mesh with the teeth of the second gear. Consequently, rotation of the second gear causes rotation of the gear and thereby rotation of the mandrel. The second gear is coupled with a handle which is coupled to a pump jack. The handle is coupled to the second gear preferably by clutch such as a friction clutch or by a ratchet mechanism. In this regard, movement of the handle in one direction causes rotation of the second gear whereas movement in the opposite direction does not cause rotation the second gear.

In an exemplary embodiment, where the second gear is a worm gear, the teeth of the first gear meshed with the tooth of the worm gear as well as the troughs between the first gear teeth are curved having a curvature that is complementary to the curvature of the gear tooth formed on the worm gear. In this regard, a larger surface area of the first gear teeth make contact with the worm gear tooth thereby allowing for more force generated by the rotation of the worm gear to be transferred to the first gear for rotating the mandrel.

DETAILED DESCRIPTION OF THE INVENTION

Figure 1A:
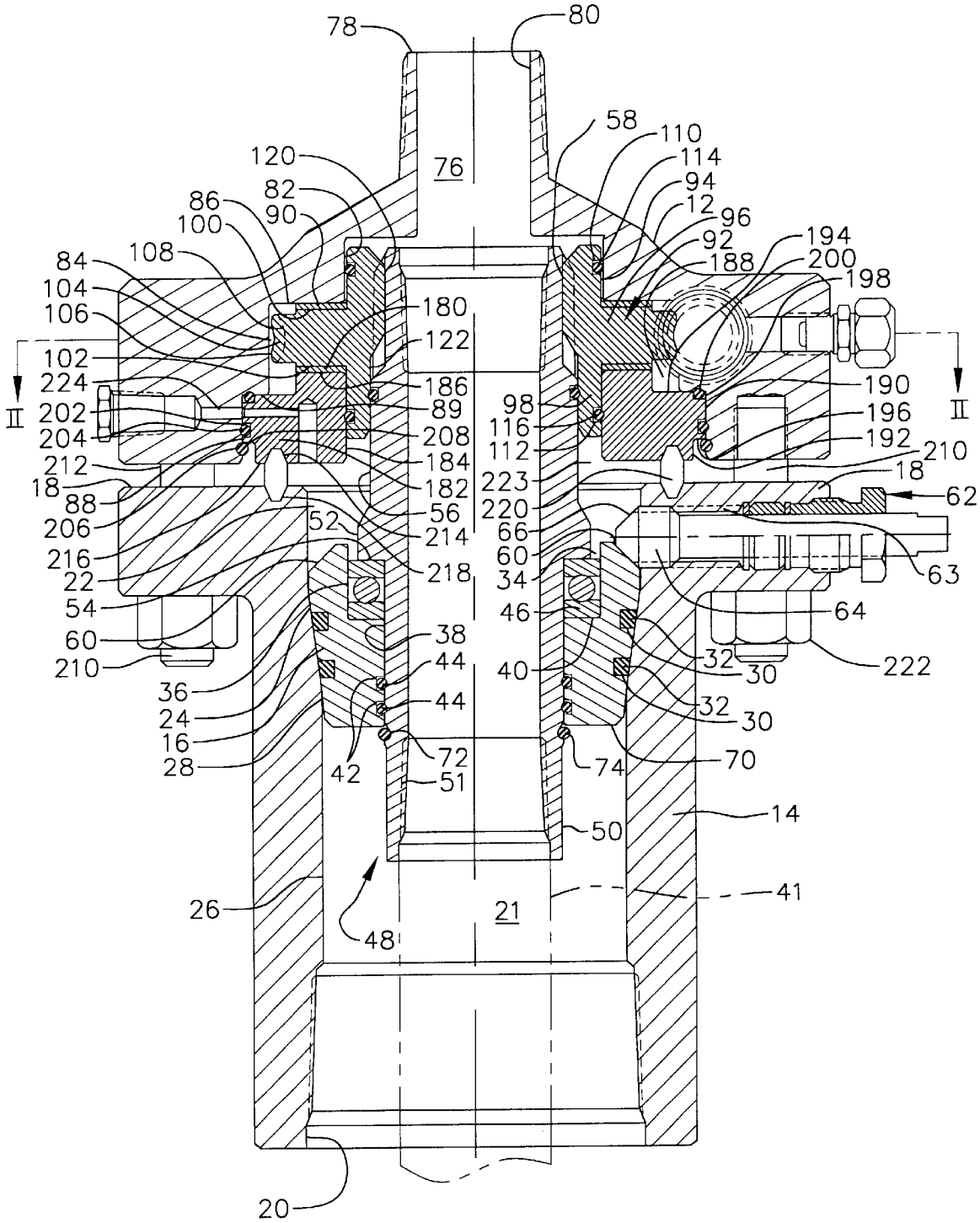
FIG. 1A is a cross-sectional view of an exemplary embodiment tubing rotator of the present invention mounted on a well casing head.

A tubing rotator 10 of the present invention is incorporated in a housing 12 which is fitted over a well casing head 14 after the landing of a tubing hanger 16. A typical well casing head is threaded or may be welded to a well casing. The casing head 14 has a flange 18 at its end opposite the end 20 coupled to the well casing. The casing head has an internal cylindrical opening 21 having a first diameter portion 22 that is relatively constant for a short distance. A second tapering portion 24 extends from the first portion 22 tapering the cylindrical opening to a smaller diameter portion 26.

The hanger 16 is also a cylindrical section having an outer surface 28 complementary to the tapering portion 24 of the well casing head internal opening 21. In an exemplary embodiment, one or more annular grooves 30 (for example, two annular grooves 30 are formed in the exemplary embodiment shown in FIG. 1A) are formed around the outer surface 28 of the hanger. A seal 32 is fitted within each groove 30. The hanger has an internal axial opening 34 comprising two sections. A first section 36 and a second section 38 coaxially extending from the first section and having a diameter smaller than the diameter first section. Consequently, an annular shoulder 40 is defined between the two sections.

In an exemplary embodiment, one or more annular grooves 42 are formed on the hanger opening second section 38 (for example, two grooves 42 are formed in the exemplary embodiment shown in FIG. 1A). A seal 44 is fitted within each of these grooves. The hanger is fitted within the well casing head such that its outer surface 28 is mated against its complementary well casing head tapering portion 24.

An annular end 60 of the hanger first section furthest from the hanger second section is tapered downwardly in a radially outward direction. A plurality of lock nuts 62, preferably at least three, are fitted through radial openings 63 defined through the casing head flange 18. The openings are preferably equidistantly spaced apart around the flange. The lock nuts have a tip portion 64 having a frusto-conical outer surface 66, i.e., a surface that is a cone section. The frusto-conical outer surface tapers at an angle complementary to the angle of the tapered end 60 of the hanger first section. The lock nuts are threaded through the openings 63 until their tip frusto-conical surface engages the annual tapered end 60 surface of the hanger applying a downward force, forcing the hanger against the decreasing inner diameter of the well casing head and causing the seals 32 on the outer surface of the hanger to energize and provide a seal between the hanger and the casing head. Moreover, the lock screws retain the hanger in position preventing it from unseating from the well casing head.

A bearing 46, as for example, an annular roller bearing having an inner diameter equal to or greater than the inner diameter of the hanger opening second section and an outer diameter smaller than the inner diameter of the hanger opening first section is seated on the hanger annular shoulder 40.

The tubing string 41 is connected to a tubing mandrel (referred to herein as "mandrel") 48. In the exemplary embodiment shown in FIG. 1A, the mandrel has a first section 50 having an outer surface diameter slightly smaller than the inner surface diameter of the hanger second section. The mandrel first section 50 has a threaded inner surface 51 for coupling with the tubing string 41. A second section 52 coaxially extends from the first section. The second section of the mandrel has a larger outer surface diameter than the first section such that it defines a mandrel annular shoulder 54 on the second section between the mandrel first and second sections. A mandrel third section 56 coaxially extends from the second section and has a diameter slightly smaller than the second section. A mandrel fourth section 58 coaxially extends from the mandrel third section and has a polygonal outer surface. In the exemplary embodiment as shown in FIG. 1A, the fourth section has a hexagonal outer surface, i.e., an outer surface that form a hexagon when viewed from an axial direction thereof.

The mandrel is fitted with its first section through the internal axial opening 34 of the hanger in a direction toward the casing such that the mandrel annular shoulder 54 rests against the bearing 46, thereby sandwiching the bearing against the hanger annular shoulder 40. When the mandrel annular shoulder 54 rests against the bearing 46, a portion of the first section 50 of the mandrel extends below the end 70 of the hanger.

In the exemplary embodiment shown in FIG. 1A, an annular groove 72 is formed on the outer surface of the mandrel at a location just below the hanger end 70 when the mandrel annular shoulder 54 rests against the bearing 46. The annular groove 72 is formed such that it extends downward and radially inward. A snap ring 74 is fitted within the annular groove or such that a portion of the snap ring extends beyond the mandrel first section 50 outer surface. In this regard, as the mandrel is slid within the hanger, the snap ring is compressed until the mandrel is seated on the bearing and the seal passes the end 70 of the hanger. When that occurs, the seal expands and provides a barrier preventing the mandrel from withdrawing from the hanger. Because the annular groove 72 extends downward and radially inward, if the mandrel attempts to withdraw from the hanger, the snap ring 74 will seat further within the groove preventing its disengagement from the groove. In other words, the snap ring acts as a retainer.

Alternatively the mandrel is seated on the bearing 46 which is seated on the hanger annular shoulder 40 forming a hanger assembly. The snap ring 74 is then fitted in the annular groove 72. The hanger assembly is then fitted in the cylindrical opening 21.

Figure 1B:
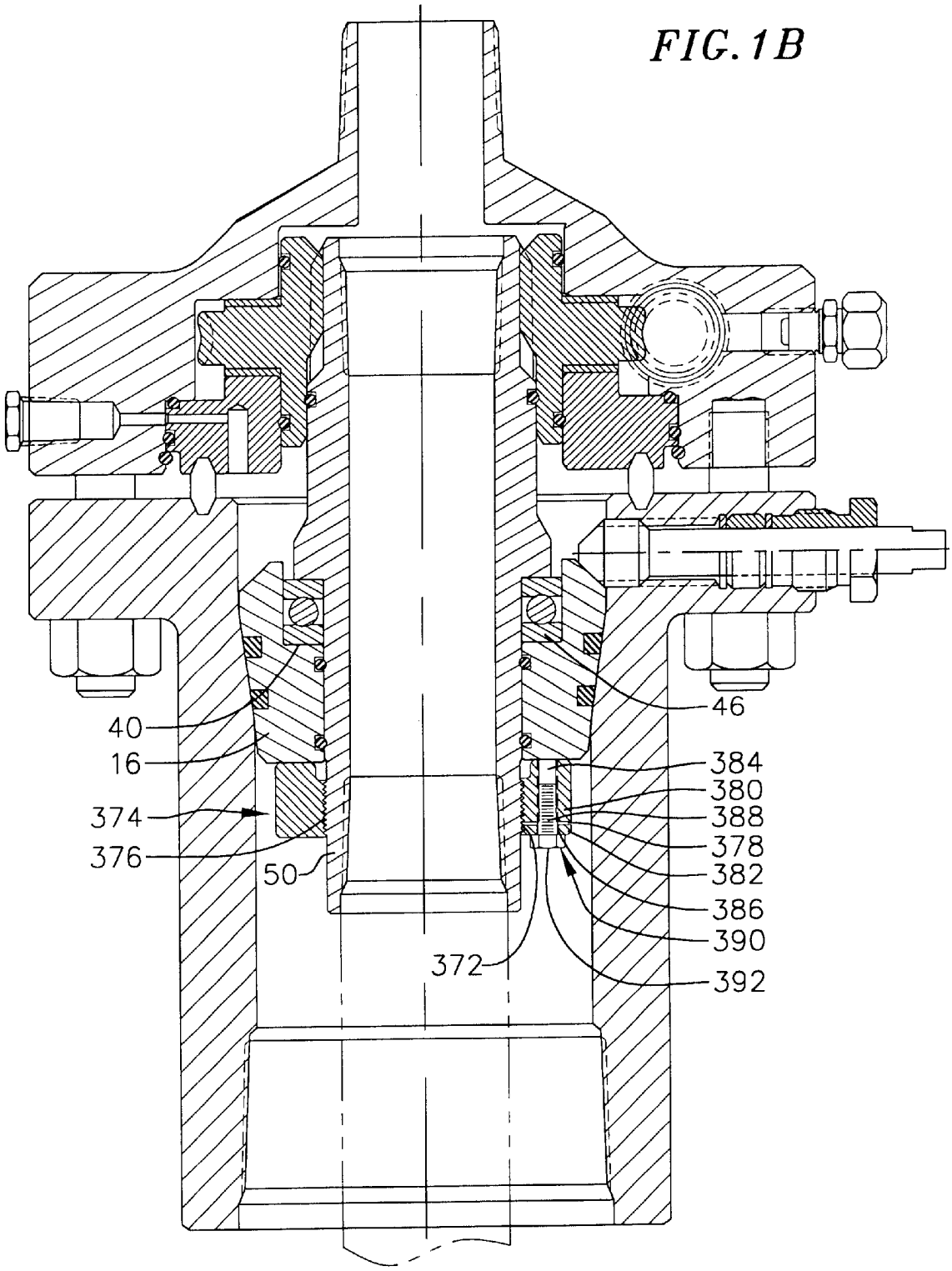
FIG. 1B is a cross-sectional view of another exemplary embodiment tubing rotator of the present invention mounted on a well casing head.

In another exemplary embodiment, shown in FIG. 1B, instead of the annular groove 72, threads 372 are formed on the outer surface of the first section 50 of the mandrel. After the mandrel is seated on the bearing seated in the hanger annular shoulder 40, the treads 372 formed on the mandrel first section outer surface 50 extend beyond the hanger 16. A mandrel retainer nut 374 having inner threads 376 is then threaded on the threads 372. In the exemplary embodiment shown in FIG. 1B, a cut 378 is formed along a portion of the mandrel retainer nut dividing that portion of the mandrel retainer nut into a first threaded section 380 and a second threaded section 382.

In the exemplary embodiment shown in FIG. 1B a threaded opening 384 is formed in the first section of the mandrel retainer nut cut portion extending from the cut 378. A coaxial opening 386 is formed through the second section of the mandrel retainer nut cut portion. A shaft 388 of a lock bolt 390 is fitted through the second section opening 386 and threaded through the threaded opening 384 formed on the first section. As the lock bolt is threaded, a head 392 of the lock bolt engages the second section 386 of the mandrel retainer nut cut portion causing the two sections to compress toward each other and thereby lock against the threads 372 formed on the outer surface of the first section of the mandrel. Consequently, the mandrel retainer nut 374 prevents the mandrel from completely unseating from the bearing 46. The mandrel retainer should be locked in a position spaced apart from the hanger 16 so as to not interfere with the rotation of the mandrel relative to the hanger.

The housing 12 is fitted over the mandrel 48 and is mated to the flange 18 of the well casing head. In the exemplary embodiment shown in FIG. 1A, bolts 210 extend from the housing. Complementary openings 212 are formed through the flange 18 of the well casing head for receiving the bolts 210. A nut 222 is threaded on each bolt 210 for fastening the housing to the well casing head 14.

The housing comprises an axial opening 76 which provides access to the mandrel from the end 78 of the housing opposite the well casing head. In the exemplary embodiment shown in FIG. 1A, the axial opening 76 comprises four sections. A first section 80 of the housing axial opening extends to the end 78 of the housing and has a diameter preferably smaller than the outer surface diameter of the mandrel fourth section 58. A second section 82 of the housing axial opening coaxially extends from the first section 80 and has a diameter larger than the diameter of the first section 80. A third section 84 of the housing axial opening coaxially extends from the second section 82 of the opening and has a diameter larger than the second section of the axial opening. Consequently, a housing first annular shoulder 86 is defined between the second and third sections of the axial opening 76. A fourth section 88 coaxially extends from the third section 84 and has a diameter larger than the third section. Consequently, a second housing annular shoulder 89 is defined between the third and fourth sections of the axial opening.

In the exemplary embodiment shown in FIG. 1A, an annular layer a friction reducing material, preferably Polytetrafluoroethlene 90 (also referred to herein as "PTFE" and often marketed under the trademark Teflon®), e.g., a PTFE washer, is attached to or placed against the housing first annular shoulder 86. Alternatively, the housing annular shoulder is coated with PTFE. The annular layer has an inner diameter which is preferably as great as the diameter of the housing axial opening second section 82. The outer diameter of the annular layer is smaller than the diameter 84 of the third section of the axial opening.

An annular gear 92 is fitted within the housing axial opening 76. In the exemplary embodiment shown in FIG. 1A, the annular gear 92 outer surface has three sections. The annular gear outer surface first section 94 has a diameter slightly smaller than the diameter of the housing axial opening second section 82. A second section 96 of the gear coaxially extends from the first section of the gear and has a diameter smaller than the diameter of the housing axial opening third section 84 but greater than the diameter of the housing axial opening second section 82. An annular gear third section 98 coaxially extends from the annular gear second section. The annular gear third section has an outer diameter smaller than the outer diameter of the annular gear second section.

Annular surfaces are defined on the annular gear second section. A first annular surface 100 is defined proximate the gear first section, and a second annular surface 102 is defined opposite the first annular surface and proximate the gear third section. Gear teeth 104 are defined on the annular gear outer surface second section 96. Preferably, the gear teeth 104, i.e., the gear teeth edges 106 and the troughs 108 between the gear teeth, are curved such that both the teeth and the troughs are concave when viewed in a radially inward direction.

In the exemplary embodiment shown in FIG. 1A, an annular groove 110 is formed on the annular gear first section 94 outer surface, and an annular groove 112 is formed on the annular gear third section 98 outer surface. These grooves are fitted with seals 114, 116, respectively.

Figure 2:
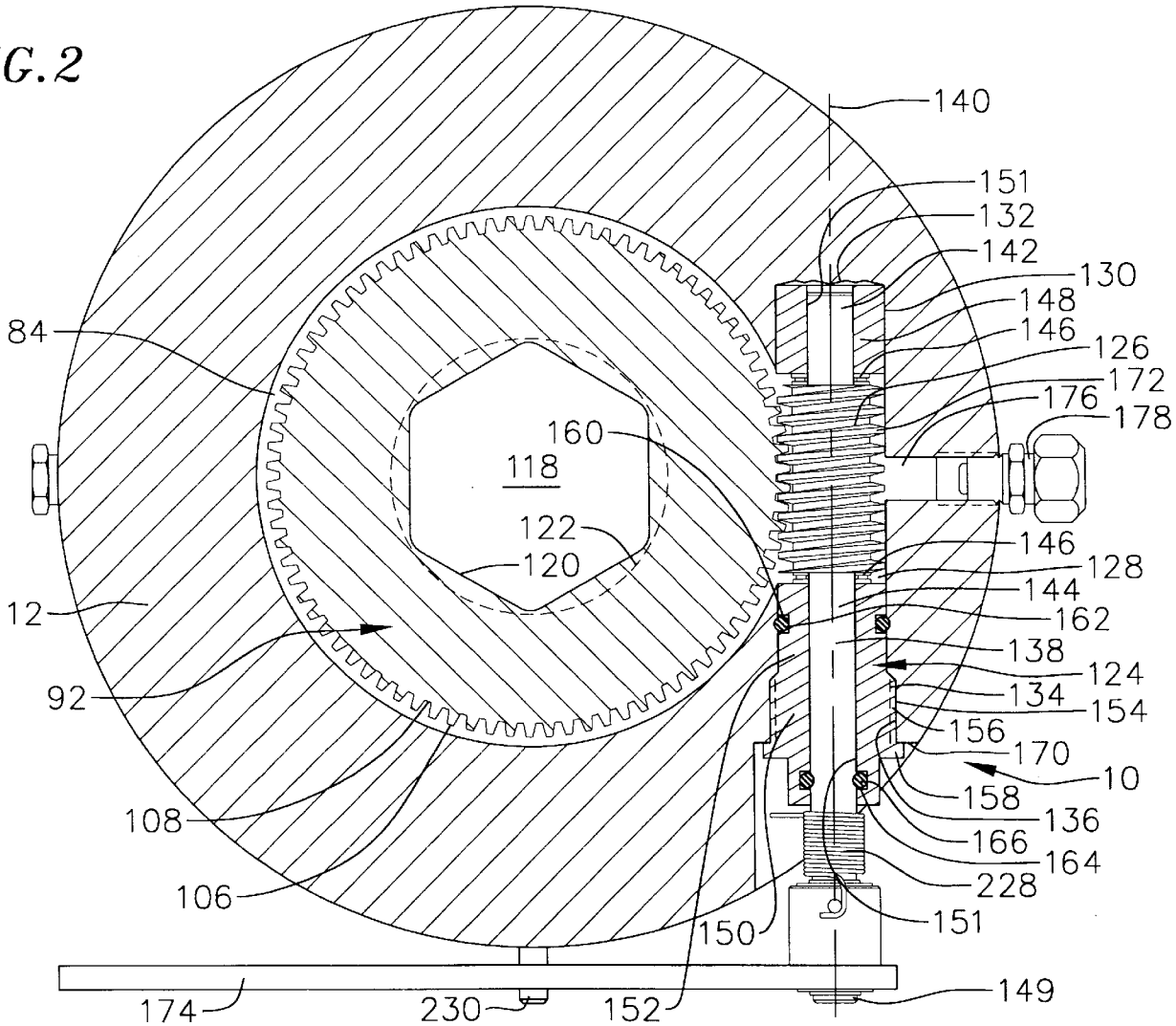
FIG. 2 is a partial cross-sectional view taken along a plane transverse to the axial opening of the housing and depicting the housing, gear and worm gear.

An axial opening 118 is formed through the annular gear 92 (FIGS. 1A and 2). In a preferred embodiment, the axial opening comprises two sections. The first section 120 is a polygonal opening complementary to the polygonal outer surface shape of the mandrel fourth section 58. In the exemplary embodiment shown in FIG. 1A, where a hexagonal mandrel outer surface fourth section is used, the annular gear opening inner surface first section has a complementary hexagonal opening such that it can slide around and mate with the hexagonal mandrel fourth section outer surface. A second section 122 of the axial opening of the gear extends coaxially from the section and has a diameter that is slightly greater than the outer surface diameter of the mandrel third section 56. In this regard, the gear can be fitted over the mandrel fourth and third sections.

The annular gear 92 is fitted into the housing axial opening such that the annular gear outer surface first section 94 is fitted within the second section 82 of the housing axial opening and the annular gear's second section 96 is fitted within the third section 84 of the housing axial opening. When the gear is fitted within the housing axial opening, the gear first annular surface 100 contacts the PTFE layer 90 or PTFE coated housing shoulder 86. In an alternate embodiment, the annular gear first annular surface may be coated with PTFE. With this embodiment, use of a PTFE layer or coating the annular shoulder 86 of the housing may not be necessary.

In the exemplary embodiment shown in FIG. 1A, a second annular layer 180 of PTFE is placed against the second annular surface 102 formed on the gear second section 96. Alternatively, the second annular surface 102 is coated with PTFE. An annular retainer 182 is fitted within the housing sandwiching the gear second section 82 against the housing.

The retainer comprises an inner surface 184 diameter which is slightly greater than the outer surface diameter of the gear third section 84. In this regard, the retainer can slidably fit over and around the annular gear third section. An annular end surface 186 of the retainer mates against the second annular layer 180 of PTFE or the PTFE coated second annular surface 102. In an alternate embodiment, the annular end surface 186 or the retainer is coated with PTFE. With this embodiment, it may not be necessary to incorporate an annular PTFE layer 180 or to coat the annular surface 102 for on the gear second section 96.

In an exemplary embodiment as shown in FIG. 1A, the annular retainer 182 has an outer surface defined by three sections. A retainer first section 188 extends from the end surface 186. The retainer first section has a diameter smaller than the diameter of the housing axial opening third section 84. A second section 190 of the retainer coaxially extends from the first section and has an outer surface diameter that is slightly smaller than the diameter of the housing axial opening fourth section 88 and greater than the diameter of the housing axial opening third section 84. A third section 192 of the retainer coaxially extends from the third section of the retainer and has a diameter that is smaller than the diameter of the retainer second section. Consequently, a retainer first annular shoulder 194 is formed on the surface of the retainer second section intersecting the first section, and a retainer annular shoulder 196 is formed on the retainer second section opposite the first annular shoulder and intersects the retainer third section. In an alternate embodiment, the retainer may only include the first two sections.

In the exemplary embodiment shown in FIG. 1A, an annular groove 198 is preferably formed on the radially outward-most end of the second section of the retainer encompassing a radially outward-most portion of the first retainer annular shoulder 194. A first seal 200 is fitted within the groove 198. A second annular groove 202 is formed on the outer surface of the retainer second section 190 and is fitted with a second seal 204. When the retainer is fitted within the housing, the end surface 186 of the retainer faces the gear second section second annular surface 102 and the layer or coating of PTFE 180 is sandwiched there between. The retainer first annular shoulder 194 abuts against the housing second annular shoulder 89 formed on the intersection between the fourth and third sections of the housing axial opening. In this regard, the first seal 200 seals against the housing second annular shoulder 89.

In the exemplary embodiment shown in FIG. 1A, an annular groove 206 is formed on a housing fourth section at an axial distance from the third section of the housing that is slightly greater than the axial length of the retainer second section 190. The annular groove 206 is formed such that it extends downward in a radially outward direction. An wire snap ring 208 is fitted within the groove having a diameter that is greater than the maximum depth of the groove. When the snap ring 208 is fitted within the groove, it provides a barrier for preventing the separation of the annular retainer from the housing. An annular groove 214 is also formed at an end surface 216 of the annular retainer opposite the end surface 186. A similar annular groove 216 is formed on the flange 18 of the well casing head.

In the exemplary embodiment shown in FIG. 2, a worm gear assembly 124 comprising worm gear 126 is fitted transversely through a transverse opening 128 in the housing such that at least a portion of the worm gear 126 extends within the third section 84 of the housing axial opening (FIG. 2) The housing axial opening third section 84 and the transverse opening 128 intersect each other. In the exemplary embodiment shown in FIGS. 1A and 2 the worm gear comprises a spiraling tooth 172 defined around the worm gear body.

The transverse opening comprises two portions, a first portion 130 and extending to an end 132 defining a base of the transverse opening, and a second portion 134 extending from the first portion 130 opposite the base and having a diameter slightly greater than the diameter of the first portion. Internal threads 136 are preferably formed within the second section of the transverse opening.

The worm assembly comprises a shaft 138. The worm gear 126 is mounted on the shaft such that the shaft 138 penetrates the worm gear along the worm gear longitudinal central axis 140 so that rotation of the shaft rotates the worm gear about its longitudinal central axis. In the exemplar embodiment, the worm gear is mounted on the shaft such that portions 142, 144 of the shaft extend from either end of the worm gear. Preferably, a thrust bearing 146 is fitted around the shaft on either end of the worm gear.

In the exemplary embodiment, the worm assembly also includes a housing having a first portion 148 and a second separate portion 150. Both portions of the housings have a central longitudinal opening 151 to accommodate the shaft. The first portion 148 of the housing is fitted over one end of the shaft and abuts the thrust bearing 46. The second portion of the housing is fitted on the other end of the shaft and abuts the other thrust bearing. An end portion 149 of the shaft 138 extends beyond the second portion of the housing in a direction opposite from the worm gear. The outer surface diameter of the worm assembly housing first portion 148 is slightly smaller than the diameter of the transverse opening first portion 130.

In the exemplary embodiment shown in FIGS. 1A and 2, the second portion 150 of the worm assembly housing has three sections. A first section 152 has an outer diameter slightly smaller than inner diameter of the transverse opening first section. A second section 154 coaxially extends from the second portion first section and has a diameter greater than the diameter of the first section but slightly smaller than the diameter of the transverse opening second portion. In the shown exemplary embodiment, threads 156 are formed on the worm gear housing second portion second section 154 for mating with the threads 136 formed on the traverse opening second portion. A third section 158 of the worm gear housing second portion has a diameter that is greater than the outer surface diameter of the transverse opening second portion 136.

An outer annular groove 160 is formed around the worm gear assembly housing second portion and is fitted with a seal 162. An inner annular groove 164 is formed within the axial opening 151 through the second portion 150 of the worm gear assembly housing and is also fitted with a seal 166.

The assembly is mounted to the transverse opening by fitting the assembly through the transverse opening such that the assembly housing first portion surrounding the shaft is fitted into the opening followed by the worm gear and the housing second portion. The housing second portion is then threaded with the threads 156 formed on the second section of the housing second portion to the threads 136 formed on the transverse opening second portion until the third section 158 of the housing second portion abuts an end surface 170 of the housing surrounding the transverse opening. As the worm gear is moved through the transverse opening, the worm gear tooth 172 engages the teeth 106 of the annular gear 92.

The shaft 138 can rotate relative to the housing but the worm gear cannot rotate relative to the shaft. In the shown exemplary embodiment, a handle 174 is transversely coupled to the shaft 138 preferably via a friction clutch (not shown). In this regard, movement of the handle in one direction will cause the shaft and thus the worm gear to rotate due to friction between the handle and the shaft, while movement of the handle in the opposite direction will not cause rotation of the shaft. Alternatively a ratchet or other similar mechanism may be used to couple the shaft to the handle.

A second opening 176 is formed through the housing extending from an outer surface of the housing to the transverse opening 128. In the exemplary embodiment shown, the second opening 176 is formed perpendicularly to the transverse opening and is fitted with a fitting 178 for providing external access to the transverse opening 128 for introducing lubrication into the transverse opening and thus to the worm gear 126 and annular gear 92.

The seal 162 mounted within the annular groove 160 on the outer surface of the worm gear assembly second portion provides a seal on the interface between the housing second portion and the transverse opening so as to prevent any lubricants from escaping through the transverse opening. Similarly, the inner seal 166 on the worm gear assembly housing second portion provides a seal for preventing any lubricants from escaping between the shaft and worm gear assembly housing second portion.

Prior to mating the housing with annular gear, worm gear assembly, and retainer to the well casing head, a metal ring 220 is fitted within the annular groove 214 formed on the retainer, or the annular groove 218 formed on the annular flange. When the housing is mounted on the well casing head, i.e., when the mandrel rotator is landed, the metal ring is fitted within both annular grooves 214 and 218.

In the exemplary embodiment shown in FIG. 1A, the metal ring acts as a seal. A space 223 is defined interior of the metal ring between the housing and the well casing head.

In the exemplary embodiment shown in FIG. 1A, a passage 224 may be formed transversely through the housing and through the annular retainer providing access to the space 223 for introducing pressure for evaluating the integrity of the seals in the entire landed mandrel rotator. This can be accomplished by applying pressure to space 223 and monitoring the pressure over a time to ascertain whether there is a decrease in pressure. A decrease in pressure would indicate that there is leakage.

Once the housing is in place, the pump jack rod and other required accessories are fitted through the axial opening 76 formed on the housing and through the mandrel. The pump jack (not shown) is coupled to the rod and is also coupled to the handle 174. In this regard, as the pump jack pumps causing the rod to move up and down, it also causes the handle to move upward and then downward. As the handle moves the worm gear rotates and causes rotation of the annular gear which causes the rotation of the mandrel, which is easily accomplished as the mandrel is seated on bearings.

Typically the handle is coupled to the pump jack with a chain, such that the pump jack is only able to pull the handle upward. However, when the pump jack releases the tension on the chain, the handle is able to rotate back to its original position due to gravity, while the friction clutch (or other similar mechanism) prevents the shaft from rotating. In an alternate embodiment, a spring 228 may be provided to aid the return of the handle to its original position (FIG. 2). A stop 230 may also be provided extending radially outward from the housing for limiting the reverse travel of the handle.

To reduce friction, a lubricant or PTFE may be provided between the gear outer surface first section 94 and the second section 82 of the housing axial opening. Moreover, the use of the bearing 46 sandwiched between the mandrel and the hanger reduces rotation friction, while the PTFE on both annular surfaces of the annular gear reduces the rotation friction of the annular gear. Similarly, the use of the thrust bearings between the worm gear housing portions and the worm gear ensure that the friction to the worm gear as it rotates is reduced.

Because the annular gear 92 is fitted on the housing, the annular gear can have a greater diameter than prior art gears which are mounted within the well casing head and as such are constrained by the dimensions of the well casing head. The increase in gear diameter over prior art gears allows for a greater gear reduction between the worm gear and annular gear thereby requiring less force to rotate the gear. Furthermore, by using an annular gear having convex gear teeth having a curvature that is complementary to the curvature of the worm gear tooth, a greater area of the worm gear tooth comes into engagement with the annular gear teeth thereby transferring a greater amount of the force generated by the worm gear to the annular gear. Consequently, with the inventive mandrel rotator; the amount of force required to rotate the mandrel is reduced.

Although this invention has been described in certain specific embodiments, many additional modifications and variations will be apparent to those skilled in the art. It is, therefore, understood that within the scope of the appended claims, this invention may be practiced otherwise than specifically described. For example, a lubricant may be used in lieu of the PTFE layers 90 and 180.

What is claimed is:

1. A well tubing rotator system comprising:

a casing head;

a mandrel rotatably mounted within the casing head, the mandrel having an inner opening and an outer surface, wherein a portion of the outer surface is polygonal having more than two sides, wherein an outer angle formed between every pair of adjacent sides is greater than 180°;

a housing mounted on the well casing head, the housing comprising an axial opening, wherein a portion of the mandrel is surrounded by the casing head and a portion of the mandrel is surrounded by the housing;

an annular gear comprising external teeth and an axial opening having a polygonal portion, the gear fitted within the housing axial opening and in surrounding relationship to the mandrel, wherein the polygonal portion of the opening of the gear surrounds the polygonal outer surface portion of the mandrel; and a second gear coupled to the annular gear, wherein rotation of the second gear causes rotation of the annular gear.

2. A system as recited in claim 1 wherein the annular gear axial opening polygonal portion is complementary to the polygonal outer surface portion of the mandrel.

3. A system as recited in claim 1 further comprising an annular retainer surrounding the mandrel, wherein the annular retainer is located below the annular gear, and wherein the annular gear is sandwiched between the housing and the annular retainer.

4. A system as recited in claim 3 further comprising a layer of PTFE between the annular gear and the retainer.

5. A system as recited in claim 1 wherein the annular gear teeth are concave when viewed in a radially inward direction thereof.

6. A system as recited in claim 5 wherein each gear tooth comprises an edge spanning the length of the tooth and wherein a trough is defined between every two consecutive gear teeth, and wherein said teeth edges and troughs are concave.

7. A system as recited in claim 5 the second gear is a worm gear comprising a tooth having a curvature when viewed in an axial direction in relation to the worm gear, wherein the worm gear tooth curvature is complementary to the concavity of the annular gear teeth.

8. A system as recited in claim 1 wherein the second gear is a worm gear transversely fitted in the housing.

9. A system as recited in claim 1 further comprising:

an hanger fitted within the well casing head wherein the mandrel is coupled to the hanger, wherein a portion of the mandrel extends beyond the hanger in a direction away from the annular gear; and a retainer coupled to said mandrel portion extending beyond the hanger for retaining said mandrel portion extending beyond the hanger.

10. A system as recited in claim 9 wherein the retainer is a snap ring fitted in a groove formed on the outer surface of the portion of the mandrel extending beyond the hanger.

11. A well tubing rotator system comprising:

a casing head;

a mandrel rotatably mounted within the casing head, the mandrel having an inner opening and an outer surface, wherein a portion of the outer surface is polygonal;

a housing mounted on the well casing head, the housing comprising an axial opening, wherein a portion of the mandrel is surrounded by the casing head and a portion of the mandrel is surrounded by the housing;

an annular gear comprising external teeth and an axial opening having a polygonal portion, the gear fitted within the housing axial opening and in surrounding relationship to the mandrel, wherein the polygonal portion of the opening of the gear surrounds the polygonal outer surface portion of the mandrel; and a second gear coupled to the annular gear, wherein rotation of the second gear causes rotation of the annular gear, wherein the housing axial opening comprises four coaxial sections, a first section extending to an end of the housing furthest from the well casing head and having a first diameter, a second section extending from the first section and having a second diameter greater than the first diameter, a third section extending from the second section having a third diameter greater than the second diameter, and a fourth section extending from the third section having a fourth diameter greater than the third diameter, wherein a housing first annular shoulder is defined on the third section extending to the second section, and wherein a housing second annular shoulder is defined on the fourth section extending to the third section.

12. A system as recited in claim 11 wherein the annular gear has an outer surface comprising three coaxial sections, a first section having a diameter slightly smaller than the first diameter, a second section having a diameter greater than the diameter of the gear first section and smaller than the third diameter and a third section having a diameter smaller than the diameter of the second section, wherein a first annular surface is defined on the gear second section extending to the gear first section, and a second annular surface is defined on the gear second section extending to the gear third section, wherein the gear external teeth are formed on the gear outer surface second section, and wherein the gear outer surface first section is fitted within the axial opening second section and wherein the first annular surface faces toward the first annular shoulder.

13. A system as recited in claim 12 further comprising a layer of PTFE between the first annular shoulder and the first annular surface.

14. A system as recited in claim 12 further comprising an annular retainer in surrounding relationship to the mandrel and comprising:

an inner surface having a diameter not smaller than the diameter of the gear outer surface third section;

an outer surface; and a first annular surface extending from the inner surface toward the outer surface, wherein the retainer annular surface faces the gear second annular surface.

15. A system as recited in claim 14 further comprising a layer of PTFE between the retainer first annular surface and the gear second annular surface.

16. A system as recited in claim 14 wherein the retainer outer surface comprises two sections, a first section extending from the retainer annular surface and a second section having an outer surface diameter greater than the diameter of the retainer outer surface first section and not greater than the axial opening fourth section, wherein a retainer second annular surface is defined on the retainer outer surface second section extending to the retainer outer surface first section, wherein the retainer second annular surface faces the axial opening second annular shoulder.

17. A system as recited in claim 14 wherein the casing head comprises a flange extending radially outward and wherein the housing is coupled to the flange.

18. A system as recited in claim 17 wherein the flange comprises a plurality of openings extending through the flange, and wherein the housing comprises a plurality of studs extending axially from housing, wherein the studs penetrate the openings, wherein a portion of the studs extend, beyond the opening and wherein the system further comprises a plurality of nuts threaded to the portions of the studs extending beyond the openings for fastening the studs and housing to the casing head.

19. A system as recited in claim 14 further comprising:

another annular surface defined on the annular retainer opposite the retainer first annular surface;

an annular groove formed on said another annular surface and surrounding the mandrel;

an annular groove formed on the well casing head surrounding the mandrel; and a seal fitted in both the annular groove formed on said another annular surface and on the annular groove formed on the wall casing head.

20. A system as recited in claim 19 further comprising:

a hanger fitted within the well casing head, the hanger having an axial opening having a first and a second section wherein the hanger axial opening first section has a diameter greater than the hanger axial opening second section, wherein a hanger annular shoulder is defined on the second section extending to the first section;

a bearing over the hanger annular shoulder;

a flange extending radially from the mandrel, wherein the bearing is sandwiched between the mandrel flange and the hanger annular shoulder.

21. A system as recited in claim 20 wherein a portion of the casing head inner surface is tapered and wherein the outer surface of the hanger is tapered, wherein the two tapered surfaces are complementary to each other, and wherein a portion of the end of the hanger extending from the hanger outer surface first section is tapered toward the hanger second section in a radially outward direction, the system further comprising a plurality of screws treaded transversely through the casing head flange, wherein each screw comprises a tip portion having a frusto-conical surface, and wherein as each screw is threaded through the flange its frusto-conical surface engages the tapered end of the hanger exerting a force on the hanger for wedging the hanger against the casing head inner tapered surface.

22. A well tubing rotator system comprising:

a casing head;

a mandrel rotatably mounted within the casing head, the mandrel having an inner opening and an outer surface, wherein a portion of the outer surface is polygonal;

a housing mounted on the well casing head, the housing comprising an axial opening, wherein a portion of the mandrel is surrounded by the casing head and a portion of the mandrel is surrounded by the housing;

an annular gear comprising external teeth and an axial opening having a polygonal portion, the gear fitted within the housing axial opening and in surrounding relationship to the mandrel, wherein the polygonal portion of the opening of the gear surrounds the polygonal outer surface portion of the mandrel;

a second gear coupled to the annular gear, wherein rotation of the second gear causes rotation of the annular gear;

a hanger fitted within the well casing head wherein the mandrel is coupled to the hanger, wherein a portion of the mandrel extends beyond the hanger in a direction away from the annular gear;

a retainer coupled to said mandrel portion extending beyond the hanger for retaining said mandrel portion extending beyond the hanger; and wherein the retainer is retainer nut threaded on threads formed on the outer surface of Said portion extending beyond the hanger.

23. A system as recited in claim 22 wherein a portion of said retainer nut threaded on threads formed on the outer surface of said portion extending beyond the hanger comprises a first section and a second section, wherein said retainer nut portion first section is spaced apart from said retainer nut second section, the system further comprising a bolt penetrating one section and threaded to the other section for pulling said first and second section toward each other for locking the retainer nut against the threads formed on the outer surface of said mandrel portion extending beyond the hanger.

24. A well tubing rotator system for rotating a well mandrel having a polygonal outer surface section, the system comprising:

a housing for mating with a well casing head, the housing comprising an axial opening;

an annular gear having an axial opening having a polygonal portion for fitting over the polygonal outer surface section of the mandrel, wherein the polygonal portion comprises more than two sides, wherein an inner angle formed between every pair of adjacent sides is less than 180°, and wherein the gear is fitted within the housing axial opening; and a second gear coupled to the annular gear, wherein rotation of the second gear causes rotation of the annular gear.

25. A well tubing rotator as recited in claim 24 further comprising a retainer, wherein the retainer is located below the annular gear and wherein the annular gear is sandwiched between the housing and the retainer.

26. A well tubing rotator as recited in claim 24 further comprising a layer of PTFE between the annular gear and the retainer.

27. A well tubing rotator as recited in claim 24 wherein the annular gear teeth are concave when viewed in a radially inward direction thereof.

28. A well tubing rotator as recited in claim 27 wherein each annular gear tooth comprises an edge spanning the length of the tooth and wherein a trough is defined between every two consecutive annular gear teeth, and wherein said teeth edges and troughs are concave.

29. A well tubing rotator as recited in claim 27 wherein the second gear is a worm gear comprising a tooth having a curvature when viewed in an axial direction in relation to the worm gear, wherein the worm gear tooth curvature is complementary to the concavity of the annular gear teeth.

30. A well tubing rotator as recited in claim 24 wherein the second gear is a worm gear transversely fitted in the housing.

31. A well tubing rotator system for rotating a well mandrel having a polygonal outer surface section, the system comprising:

a housing for mating with a well casing head, the housing comprising an axial opening;

an annular gear having an axial opening having a polygonal portion for fitting over the polygonal outer surface section of the mandrel, the gear fitted within the housing axial opening; and a second gear coupled to the annular gear, wherein rotation of the second gear causes rotation of the annular gear, wherein the housing axial opening comprises four coaxial sections, a first section extending to an end of the housing and having a first diameter, a second section extending from the first section and having a second diameter greater than the first diameter, a third section extending from the second section having a third diameter greater than the second diameter, and a fourth section extending from the third section having a fourth diameter greater than the third diameter, wherein a housing first annular shoulder is defined on the third section extending to the second section, and wherein a housing second annular shoulder is defined on the fourth section extending to the third section.

32. A well tubing rotator as recited in claim 31 wherein the annular gear has an outer surface comprising three coaxial sections, a first section having a diameter slightly smaller than the first diameter, a second section having a diameter greater than the diameter of the gear first section and smaller than the third diameter and a third section having a diameter smaller than the diameter of the second section, wherein a first annular surface is defined on the gear second section extending to the gear first section, and a second annular surface is defined on the gear second section extending to the gear third section, wherein the gear external teeth are formed on the gear outer surface second section, and wherein the gear outer surface first section is fitted within the axial opening second section and wherein the first annular surface faces toward the first annular shoulder.

33. A well tubing rotator as recited in claim 32 further comprising a layer of PTFE between the first annular shoulder and the first annular surface.

34. A well tubing rotator as recited in claim 32 further comprising an annular retainer comprising:

an inner surface having a diameter not smaller than the diameter of the gear outer surface third section;

an outer surface; and a first annular surface extending from the inner surface toward the outer surface, wherein the retainer annular surface faces the gear second annular surface.

35. A well tubing rotator as recited in claim 34 further comprising a layer of PTFE between the retainer first annular surface and the gear second annular surface.

36. A well tubing rotator as recited in claim 34 wherein the retainer outer surface comprises two sections, a first section extending from the retainer annular surface and a second section having an outer surface diameter greater than the diameter of the retainer outer surface first section and not greater than the axial opening fourth section, wherein a retainer second annular surface is defined on the retainer outer surface second section extending to the retainer outer surface first section, wherein the retainer second annular surface faces the axial opening second annular shoulder.

37. A well tubing rotator as recited in claim 34 further comprising:

another annular surface defined on the annular retainer opposite the retainer first annular surface; and an annular groove formed on said another annular surface for receiving a seal.

38. A well tubing rotator system for rotating a well mandrel, the system comprising:

a housing for mating with a well casing head, the housing comprising an axial opening;

an annular gear for driving the mandrel, said annular gear, wherein said annular gear is fitted within the housing axial opening;

a second gear coupled to the annular gear, wherein rotation of the second gear causes rotation of the annular gear; and a retainer within the housing located below the annular gear and interfacing with the annular gear via a reduced friction surface, wherein the reduced friction surface reduces rotational friction between the annular gear and the retainer.

39. A well tubing rotator system as recited in claim 38 wherein said reduced friction surface is a layer PTFE.

40. A well tubing rotator as recited in claim 38 wherein said annular gear interfaces with the housing via a reduced friction surface.

41. A well tubing rotator system comprising:

a casing head;

a mandrel rotatably mounted within the casing head, the mandrel having an inner opening and an outer surface, wherein a portion of the outer surface is polygonal;

a housing mounted on the well casing head, the housing comprising an axial opening, wherein a portion of the mandrel is surrounded by the casing head and a portion of the mandrel is surrounded by the housing;

an annular gear comprising external teeth and an axial opening having a polygonal portion, the gear fitted within the housing axial opening and in surrounding relationship to the mandrel, wherein the polygonal portion of the opening of the gear surrounds the polygonal outer surface portion of the mandrel;

a second gear coupled to the annular gear, wherein rotation of the second gear causes rotation of the annular gear; and an annular retainer below the annular gear, the annular surrounding the mandrel, wherein the annular gear is sandwiched between the housing and the annular retainer.

42. A well tubing rotator system for rotating a well mandrel having a polygonal outer surface section, the system comprising:

a housing for mating with a well casing head, the housing comprising an axial opening;

an annular gear having an axial opening having a polygonal portion for fitting over the polygonal outer surface section of the mandrel, the gear fitted within the housing axial opening;

a second gear coupled to the annular gear, wherein rotation of the second gear causes rotation of the annular gear; and a retainer below the annular gear, wherein the annular gear is sandwiched between the housing and the retainer.

* * * * *